United States Patent [19]

Braithwaite et al.

[11] Patent Number: 4,665,995

[45] Date of Patent: May 19, 1987

[54] WEDGING ASSEMBLY FOR BOREHOLE STEERING OR BRANCHING

[75] Inventors: Richard W. Braithwaite, Rugby; Graham M. Smith, Coventry; Norman W. Bellamy, Coventry; Stephen Gergely, Coventry, all of United Kingdom

[73] Assignee: Encore Drilling Limited, Warwickshire, United Kingdom

[21] Appl. No.: 756,494

[22] PCT Filed: Oct. 31, 1984

[86] PCT No.: PCT/GB84/00369

§ 371 Date: Aug. 29, 1985

§ 102(e) Date: Aug. 29, 1985

[87] PCT Pub. No.: WO85/01983

PCT Pub. Date: May 9, 1985

[30] Foreign Application Priority Data

Nov. 1, 1983 [GB] United Kingdom ..... 8329138

[51] Int. Cl.[4] ..... E21B 7/08

[52] U.S. Cl. ..... 175/45; 166/117.5; 175/73

[58] Field of Search ..... 175/45, 61, 73, 75, 175/325, 385; 166/117.5, 117.6

[56] References Cited

U.S. PATENT DOCUMENTS

| | | | |
|---|---|---|---|
| 2,401,893 | 6/1946 | Williams, Jr. | 166/117.6 |
| 3,131,778 | 5/1964 | Emersen et al. | 175/45 |
| 3,275,983 | 9/1966 | Kaneko | 175/45 |
| 3,693,142 | 9/1972 | Jones | 175/45 |
| 3,889,228 | 6/1975 | Shawhan | 340/18 FM |
| 4,003,017 | 1/1977 | Bailey | 175/45 |
| 4,293,937 | 10/1981 | Sharp et al. | 367/82 |
| 4,391,336 | 7/1983 | Coon et al. | 175/45 |
| 4,420,049 | 12/1983 | Holbert | 175/45 |
| 4,479,564 | 10/1984 | Tanguy | 175/45 |

FOREIGN PATENT DOCUMENTS

| | | |
|---|---|---|
| 1240830 | 7/1971 | United Kingdom . |
| 2111678 | 7/1983 | United Kingdom . |

*Primary Examiner*—Stephen J. Novosad
*Assistant Examiner*—Willian P. Neuder
*Attorney, Agent, or Firm*—Brown, Martin Haller & Meador

[57] ABSTRACT

A wedging assembly for steering or branching a borehole comprises a wedge defining the steering or branching angle, a locking device for locking the wedge in a desired position, and an actuator for actuating the locking device, the locking device including cooperable male and female locking members which are relatively moveable to cause an annular locking surface on the female member to lock firmly about the wall of the borehole.

8 Claims, 19 Drawing Figures

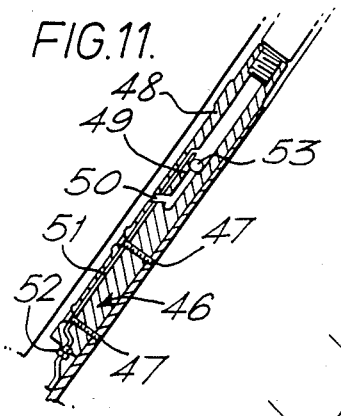
FIG.11.
48
49
53
50
51
47
52
46
47
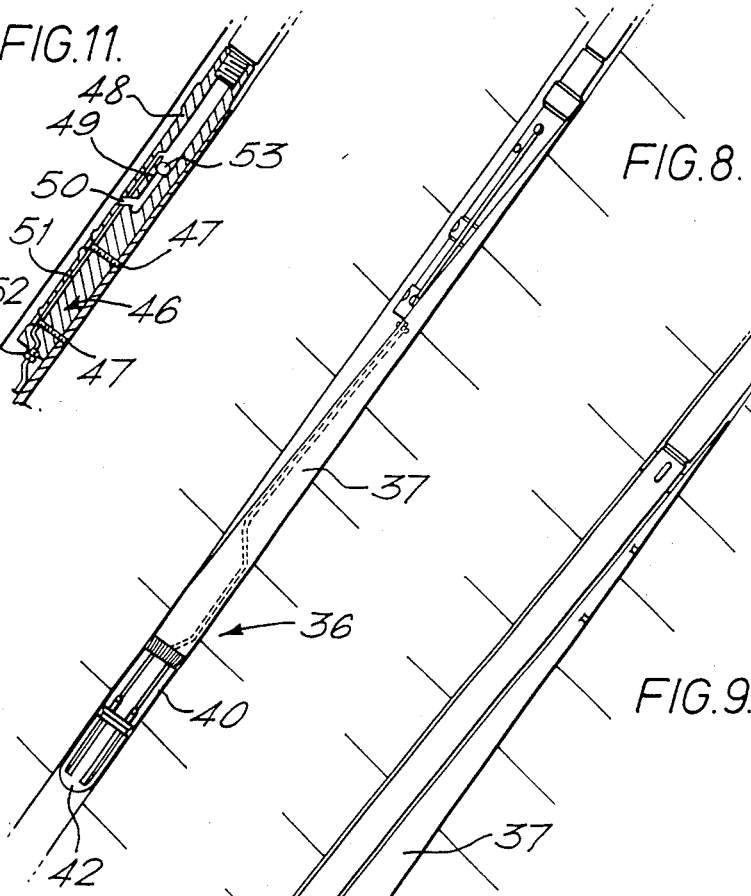
FIG.8.
37
36
40
42
FIG.9.
37
36
40
42

TOP SIDE OF
INCLINED HOLE.

WEDGING ASSEMBLY FOR BOREHOLE STEERING OR BRANCHING

This invention relates to an improved method of drilling and to apparatus for carrying out the method.

In drilling it is well known that a borehole tends to deviate from the desired line and therefore it may be necessary to monitor its deviation and to take corrective measures to the inclination of the borehole. Drilling, being primarily a method by which rock samples may be obtained for analysis, tends to be exploratory and inexact. Thus, although borehole deviation may be monitored and controlled by steering, it may also be desired to use the same borehole from which to obtain rock samples from other adjacent areas. In this case the original borehole is branched at an appropriate depth and orientation to avoid the need to drill a new borehole thereby keeping costs to a minimum.

The drill hole inclination angle and azimuth angle are normally monitored either using an electronic data collection system or a one shot system taking measurements at selected stations. Where steering or branching is required this is usually orientated using a wedge clinometer which is aligned exactly within the borehole and which receives a glass vial of hydrofloric acid. A line is scratched lengthwise on the glass vial and on the wedge clinometer and the two lines are aligned before the clinometer is lowered into the borehole. The clinometer is left within the borehole a sufficient time to allow the acid to etch a line on the glass vial and the clinometer is then withdrawn and the orientation of the wedge determined. This method can only orientate a steering or branching wedge relative to the (known) dip of a hole. It is also known to use an electronic magnetic orientation device which is run in the borehole with a logging cable. This method orientates a wedge relative to magnetic north and therefore is unsatisfactory where the rock is magnetised in any way.

Once the exact orientation of the steering or branching wedge has been determined such corrective measures as may be necessary are taken. If it is required to alter the course of a borehole, a wedging assembly is used to steer or deflect the borehole in the desired direction and may achieve a correction of 1 to 1½ degrees per setting. The most common steering wedging assembly in present use is The Clappison Wedge which tightens against one side of the borehole and prevents rotation during the deflection drilling but which can be removed after use. The deflection drilling involves drilling off the wedge a pilot hole of smaller diameter than the borehole. The pilot hole is then reamed out following the intended direction of deflection and is enlarged to full borehole diameter. The reaming assembly used to widen the pilot hole is then withdrawn from the borehole whereupon drilling is resumed. This procedure can be repeated as desired in order to achieve the necessary angular correcton.

Where a branch is required to obtain samples from areas laterally spaced from the original borehole it is usual to employ a fixed deflecting wedge which remains in the hole to ensure that the drilling operation is conducted down the branch borehole, rather than the main borehole, each time. Previously, this has involved filling or plugging the main borehole back to the branch position and then setting a wedge at the desired orientation which involves several steps each involving running in and drawing out the drill rods.

Therefore in accordance with one aspect of the invention there is provided orientation means for determining orientation within a borehole comprising sensing means for sensing the orientation relative to a predetermined datum, an ultrasonic transmitter arranged to transmit a signal or signals indicative of the sensed orientation, and an ultrasonic receiver for receiving and representing the signal or signals transmitted. Preferably the sensing means is sensing the orientation of a wedging assembly relative to the dip of the borehole, but it may be used to sense the actual hole inclination.

Preferably the sensing means are a plurality of gravity sensitive mercury switches.

The transmitter is preferably a battery-powered sonar transmitter fixed inside the lowest drill rod which emits signals up the water filled drill rod string to the surface where the signals are received and displayed.

According to another aspect of the present invention there is provided a drilling method for steering or branching a borehole in a desired direction comprising the steps of: selectively positioning a retrieveable or a fixed deflection wedging assembly within the borehole as required, sensing the orientation of the wedging assembly within the borehole with sensor means, transmitting an ultrasonic signal or signals indicative of said sensed orientation to an ultrasonic receiver at the surface, orientating said wedging assembly as desired by monitoring said receiver, locking the wedging assembly in the desired orientation, and deflecting the borehole by drilling off the wedging assembly.

In the case of a retrievable wedge, a pilot hole is formed. This pilot hole is opened out by means of a pilot spear reaming assembly which can be recovered by wire-line therby allowing normal core drilling to continue without pulling out the drilling assembly. In the case of the fixed, branching, wedge the new hole is formed by drilling off the wedge with a standard core barrel.

The transmitter is preferably a battery-powered sonar transmitter fixed inside the lowest drill rod which emits signals up the water filled drill rod string to the surface where the signals are received and displayed.

The invention also includes a wedging assembly for steering or branching a borehole comprising a wedge defining the steering or branching angle, locking means for locking the wedge in the borehole at a desired position or orientation, and means for actuating said locking means the locking means being annular and engaging about the wall of the borehole.

The wedging assembly may be a retrievable assembly for borehole steering or a fixed assembly for branching. Where the wedging assembly is retrievable the assembly comprises the wedge defining the steering deflection, an annular female locking cone, a male locking means, one of the locking means being on or adjacent the trailing end of the wedge, and a pilot hole drilling means being connected by first, preferential, shear means, and the male locking means and the pilot hole drilling means being connected by second shear means, the arrangement being such that shearing of the first shear means locks the wedge in position and shearing of the second shear means releasing the pilot hole drilling means for drilling, the pilot hole drilling means including two interfering upsets, a first upset arranged to release the male locking means from the female locking means to release the wedge from the borehole on withdrawal of the drilling means by a first amount, the second upset being arranged to interfere with the female locking means and/or the wedge to retrieve the same on continued withdrawal of the drilling means.

The male locking means may also be cooperable locking cone and suitably its surface is tuned to provide interengagement consistent with the locking force to be achieved.

In the case of a fixed wedging assembly the invention comprises the wedge defining the branch, locking means including an annular female locking cone and a male locking cone and means for moving one of the locking cones or the male locking means into engagement with the other so as to cause the female locking cone to lock about the wall of the borehole.

Preferably the moving means comprises a piston head on the female locking cone and means for supplying fluid under pressure behind said piston head for forcing the female locking cone onto the male locking means.

Where steering of a borehole has been carried out a pilot hole of smaller diameter than the borehole diameter is formed since otherwise there would be no way of retrieving the wedging assembly. Preferably the pilot hole is reamed out to borehole diameter by pilot hole reaming means comprising an outer core barrel having a reaming head, a wire-line retrievable inner barrel, a pilot spear rod having a pilot spear at the leading end thereof, the pilot spear being contractable from pilot hole diameter to less than the inner diameter of the outer core barrel, first preferential shear means between the pilot spear rod and the inner barrel, and second shear means allowing contraction of the pilot spear to less than the inner diameter of the outer core barrel, the arrangement being such that the pilot spear follows the pilot hole until the first shear means is broken, the outer and inner barrels then move relative to the pilot spear to ream out the pilot hole to borehole diameter to a position adjacent the pilot spear whereupon the second shear means is broken causing contraction of the pilot spear and allowing wire-line retrieval of the pilot spear assembly without removal of the outer core barrel from the borehole.

The invention will now be described by way of example with reference to the accompanying drawings in which:

FIG. 8 is a side elevation of a permanent branching wedge in accordance with the invention;

FIG. 9 is a side elevation illustrating drilling off the branching wedge in FIG. 8;

FIG. 11 is a diagrammatic side elevation of the wedge running tool for use with the wedge of FIGS. 8 and 9;

Figure 17A:
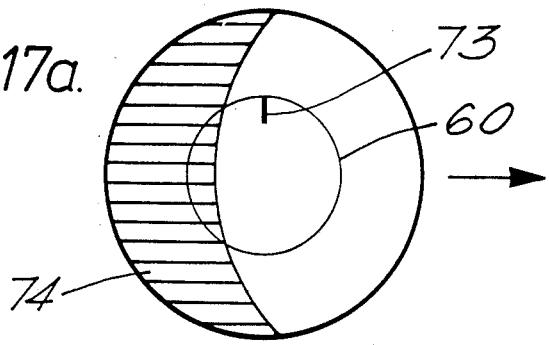
Figure 17B:
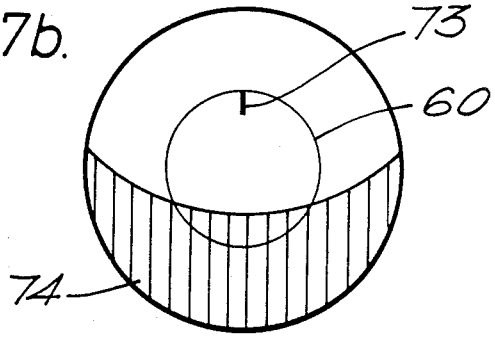
Figure 17C:
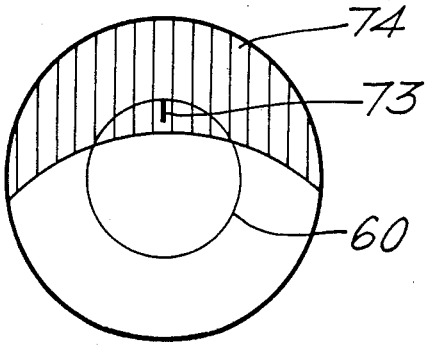

FIGS. 17*a*, 17*b* and 17*c* are diagrammatic views showing orientation of a wedging assembly.

The natural deviation of boreholes during drilling is a recognised problem encountered which is constantly monitored and may be corrected as appropriate in order that the borehole reaches the desired area for sample collecton. Once deviation has been sensed, and it is desired to correct that deviation, the sample drill rods and drill bit are withdrawn and a retrievable wedge and pilot hole drilling assembly as shown in FIGS. 1 to 5 are inserted.

Figure 3:
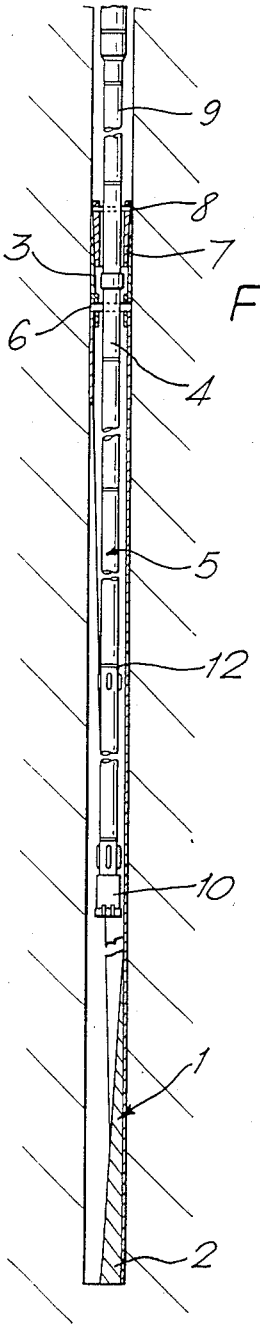
FIG. 3 is a diagrammatic view of the retrievable wedge and locking means of FIG. 1 in position.
Figure 4:
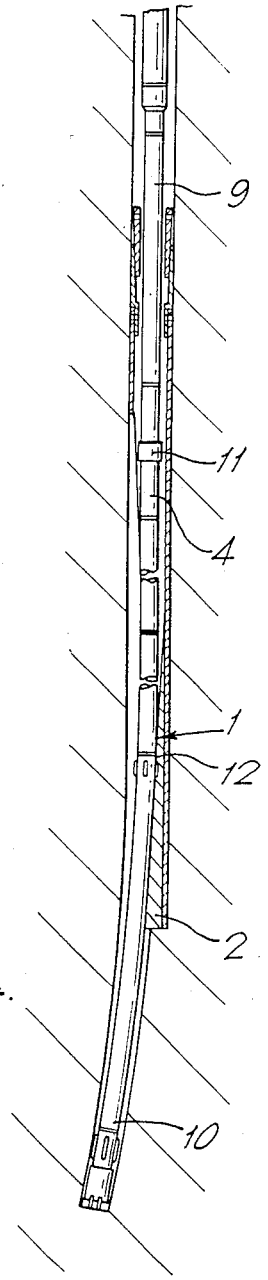
FIG. 4 is a diagrammatic view of the formation of the pilot hole by drilling off the wedge with the drilling assembly of FIG. 2.

The assembly shown comprises an elongate, open-sided steel wedge 1, curved in cross-section, providing a maximum of $1\frac{1}{2}$ degrees deviation at the leading edge 2 thereof and having a female locking cone 3 secured at its trailing end. The female locking cone 3 is locked to a shear pin sub 4 on a pilot hole drilling assembly 5 by a small shear pin 6. A male locking cone 7, cooperable with the female locking cone 3 also receives the drilling assembly 5 and is secured to the shear pin sub 4 by a large shear pin 8. The pilot hole drilling assembly 5 comprises a plurality of interconnected drill rods 9 and a core barrel and bit 10. The assembly 5 has a first annular retrieving shoulder 11 on the shear pin sub 4 which interferes with the male locking cone 7 and a second annular retrieving shoulder 12 on the core barrel 10 for retrieval of the female locking cone 3, and steel wedge 1 as will be explained. The shoulder 11 in use, is positioned downstream of the male locking cone 7 as seen in FIG. 3.

The female locking cone 3 has a number of slits 13 at its operative end and has longitudinal flutes 14 extending between the ends of the slits 13 and the other end of the cone 3 to help displace water in the borehole on running the assembly into the borehole.

Figure 5:
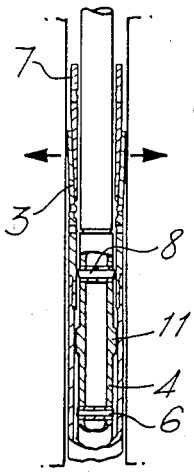
FIG. 5 is a sectional view of the locking means of FIGS. 1 to 4.

Once the steel wedge 1 is at the bottome of the borehole, and the correct orientation has been achieved as will be explained, the drilling assembly is shocked to break the small shear pin 6. This will cause a small drop to be noticed at the surface as the male locking cone 7 and pilot hole drilling assembly 5 move downwardly causing the the female cone 3 to splay outwardly and lock tightly about the borehole. With the female cone 3 locking the wedge 1 in position a further shock is applied to the pilot hole drilling assembly 5 which breaks the large shear pin 8 freeing the pilot hole drilling assembly 5 from the male cone 7 and allowing the pilot hole to be drilled with an angle of deviation determined by the wedge 1. FIG. 5 shows the locking cones engaged with the shear pins 6 and 8 in their failed positions.

In order to retrieve the assembly the pilot hole drilling assembly 5 is withdrawn until the shoulder 11 on the shear pin sub 4 interferes with the male cone 7. This interference and the upward force applied to the pilot hole drilling assembly.5 separates the male cone 7 from the female cone 3 aided by water pressure. The water pressure build up is caused by a block in the return flow path for water between the shoulder 11 and the female cone 3 when the shoulder 11 interferes with the male cone 7. This pressure build up can be noted on the water pressure gauge at the surface and separation is indicated by a pressure drop. With the locking cones 3 and 7 separated, the female cone 3 is lifted up along with the wedge 1 by the further shoulder 12 on the core barrel 10.

The locking force of the female locking cone 3 can be tuned to the power of the drilling rig by controlling the contact area of the male cone 7 with the female cone 3. In this way removal of the wedge 1 can be assured. The wedging system in FIGS. 1 to 5 thus allows the whole assembly to be run as one unit in one drilling trip with nothing left in the hole.

Figure 6:
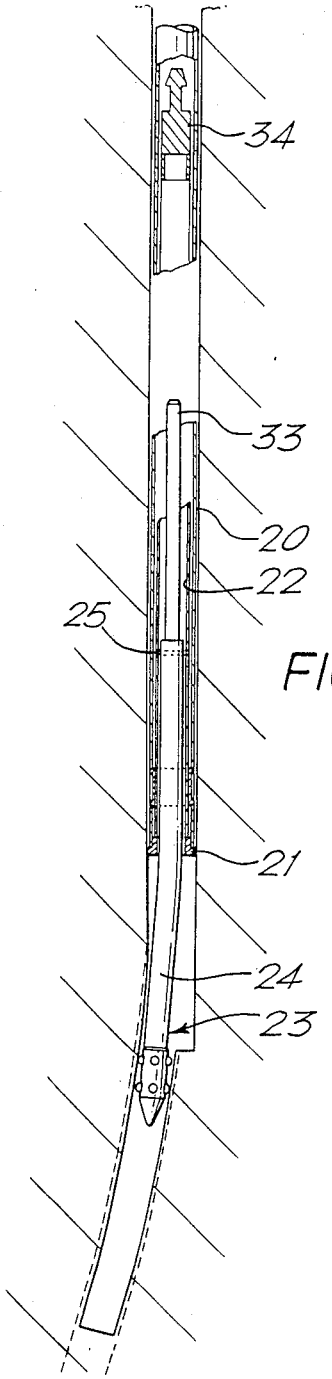
FIG. 6 is a diagrammatic side elevation of a retrievable pilot spear assembly in accordance with the invention.
Figure 7:
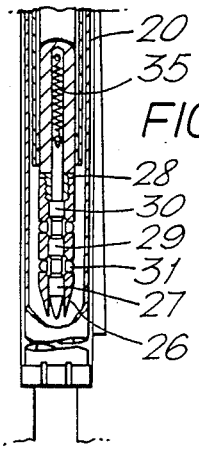
FIG. 7 is a side sectional view of the pilot spear of FIG. 6.
Figure 10:
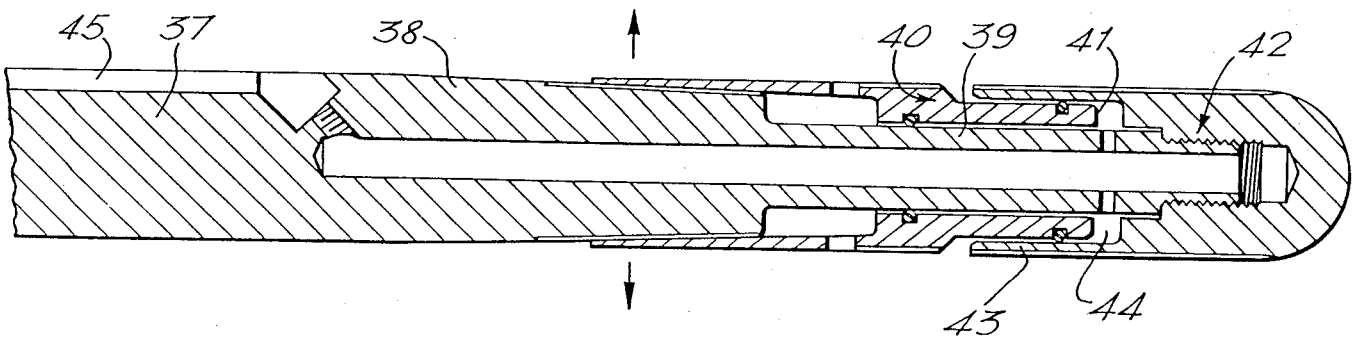
FIG. 10 is a sectional view of the locking means of the permanent branching wedge of FIGS. 8 and 9.

Once the pilot hole has been formed on the deviated line the pilot hole needs to be reamed out to the diameter of the main borehole: this is achieved using the assembly shown in FIGS. 6 and 7. The assembly comprises a standard outer core barrel 20 having a bit and reaming head 21 of the desired borehole diameter. The outer core barrel 20 is attached to a standard wire-line retrievable inner core barrel 22 by conventional snap-engageable clips (not shown) which engage with the outer core barrel.

The improvement of the reaming assembly of the present invention lies in the provision of a pilot spear 23 which is wire-line retrievable without removal of the outer core barrel 20 and reaming head 21 from the borehole. A pilot spear 23 is positioned in advance of the reaming head on the end of a pilot spear rod 24 and is used to guide the borehole diameter reaming head into the pilot hole to ream it out to borehole diameter. However previously, once the pilot spear has reached the end of the pilot hole, the whole drilling assembly has to be removed from the borehole to allow removal of the pilot spear before drilling can continue. In the present invention the pilot spear rod 24 is attached to the inner barrel 22 by a first shear pin 25. At the end of the spear rod 24 is the pilot spear 23 which is formed of an outer casing 26 of the same outside diameter as the inside diameter of the inner core barrel 22, and an inner plunger 27 which is secured to the pilot spear rod 24 by a second shear pin 28. The inner plunger 27 has two annular camming surfaces 29 and 30 which, in the normal position of the plunger 27, urge a plurality of steel balls 31 outwardly through respective apertures in the outer casing 26 so that the outer diameter of the pilot spear 23 as defined by the steel balls 31 corresponds to the diameter of the pilot hole being followed. Once the end of the pilot hole is reached a shock is applied to the drilling assembly so that the first shear pin 25 breaks. This allows the outer and inner barrels 20, 22 to pass over the pilot spear rod 24 allowing the bit to ream out the pilot hole to borehole diameter until a nose cone operating rod 33 abuts the inner barrel head 34 (FIG. 6). This shears the second shear pin 28 disengaging the plunger 27 from the outer casing 26 thereby permitting a spring 35 to withdraw the plunger 27 sufficiently to permit retraction of the steel balls 31. With the outer diameter of the pilot spear 23 now reduced to less than the corresponding inner diameters of the inner and outer barrels 22, 20 (as shown in FIG. 7), the pilot spear 23 can be retrieved by wire-line retrieval of the inner core barrel 22 in conventional manner by engagement with the core barrel head 34. A standard inner barrel can now be lowered into the outer barrel 20 in the conventional manner and drilling can then continue without running up the whole drilling assembly to remove the pilot spear.

As explained in the introduction to the specification, in some instances it is desirable to form one or more branch holes from the main borehole in order to obtain rock samples from adjacent areas without drilling new boreholes. In such a case it is necessary to provide a fixed wedge at the branch which remains in the borehole in order to ensure that the drilling line follows the branch on each running in of the assembly.

In FIGS. 8, 9, 10 and 11 there is shown a fixed wedging assembly 36 which obviates the need to fill or block off the main borehole up to the level of the branch. The assembly 36 comprises a fixed wedge 37, having a trailing wedge surface (shown in FIG. 9) inclined to provide the desired branch angle. Adjacent one end of the wedge 37 there is provided a male locking cone surface 38 which adjoins a smaller diameter projection 39 at the leading end of the wedge 37. A movable female locking cone 40, formed with slots as disclosed with reference to FIGS. 1 and 2, surrounds the male cone surface 38, and has a piston head 41 which embraces the projection 39 on the wedge. A nose cone 42 is secured to the projection 39 and defines a cylinder 43 for the piston head 41 with the cylinder chamber 44 therebetween. Connected to the chamber 44 is a flow path for flushing fluid which connects with copper piping disposed in a slot 45 in the wedge 37 leading from a wedge running tool 46 (FIG. 11) which is threaded to the lowermost drill rod adjacent to the wedge 37.

The wedge running tool 46 is tapered to the angle of the trailing end of the wedge 37 and is secured to it by shear screws 47. The wedge running tool 46 allows the flow of flushing fluid down the drill string to be harnessed by means of barrier 48 having a seating 49. The seating 49 surrounds a branched flow path 50 (only one branch shown) which, on running in of the wedging assembly, allows flushing fluid to pass. Between the seating 49 and the trailing end of the wedge running tool 46 is a by-pass conduit 51 which leads to a screw connection 52 for connection of the copper pipe leading to the chamber 44.

Figure 1:
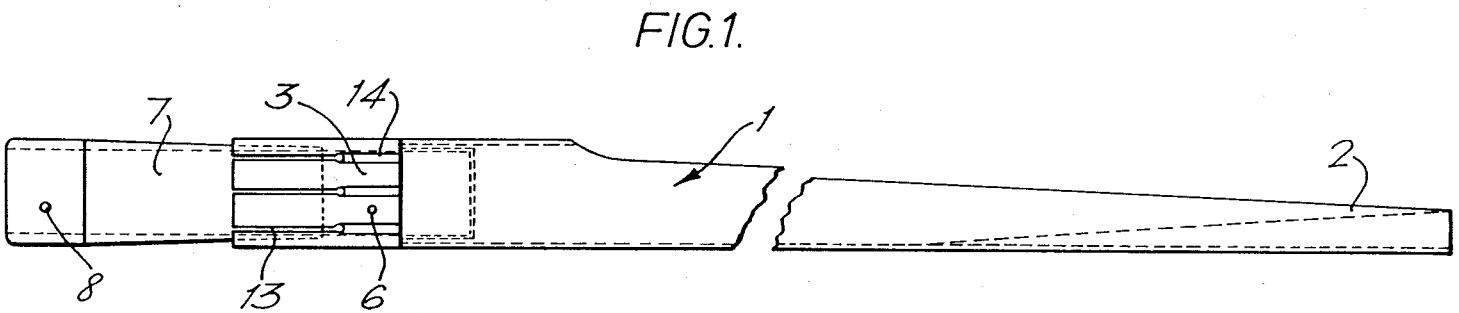
FIG. 1 is a side elevation of a retrievable wedge and locking means in accordance with one aspect of the invention.
Figure 2:
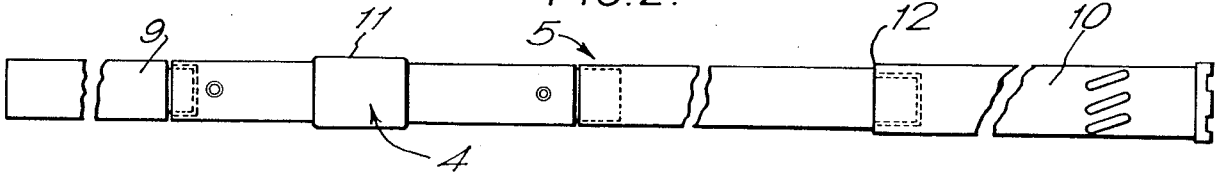
FIG. 2 is a side elevation of a pilot hole drilling assembly.

The fixed wedge 37 is used only for branching away from an original hole and is not used for subsequent steering for which the retrievable wedge of FIGS. 1 and 2 would be used. The assembly is run in to a desired depth with fluid passing through flowpath 50 in the wedge running tool 46 and is orientated as hereinafter described. Then, in order to permanently set the wedge in position, a ball bearing 53 is dropped into the drill string which locates in the seating 49. Flushing fluid pressure is then applied to the chamber 44 via the drill rods, the by-pass conduit 51 in the running tool and the copper piping. This pressure forces the piston head 41 and the female locking cone 40 into engagement with the male locking cone 38. Because of the conical surfaces of the cooperating locking portions 38 and 40, and the slits in the female locking cone 40, the female locking cone 40 is splayed outwardly to lock the wedge firmly against the borehole resisting completely pull, thrust and rotation. The locking portions 38 and 40 are made of dissimilar metals to improve the lock.

If there is a danger of the branched hole washing out the rock around the locking mechanism then the locking mechanism can be run several meters lower than the wedge on extension rods.

Once the wedge is fixed in position the shear screws 47 holding the wedge 37 to the running tool 46 are sheared allowing the drill string to be recovered from the borehole severing the copper pipe. The borehole is then branched off the wedge 37 using a full diameter standard core barrel.

Figure 12:
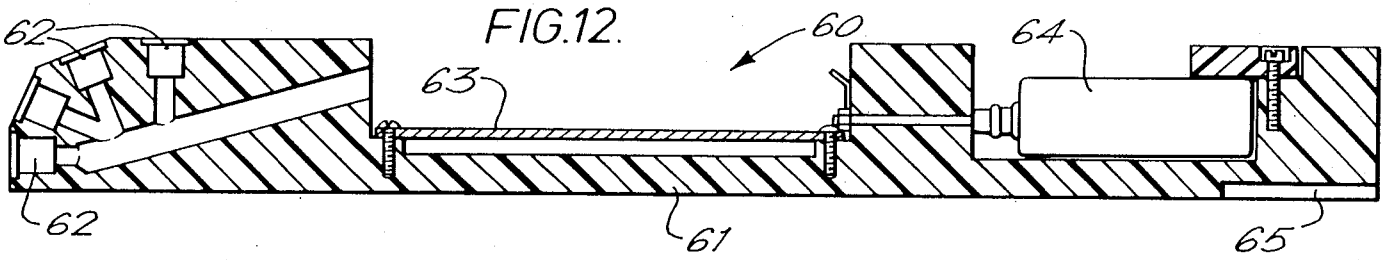
FIG. 12 is a side, part-sectioned elevation of an orientating probe in accordance with the invention.
Figure 13:
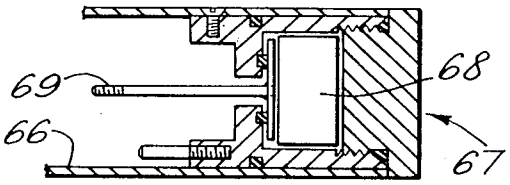
FIG. 13 is a sectional view of an ultrasonic sender unit for the probe of FIG. 12.
Figure 14:
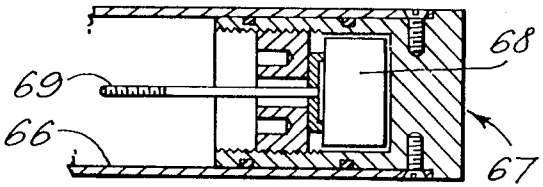
FIG. 14 is a sectional view of an alternative ultrasonic sender unit for the probe of FIG. 12.
Figure 15:
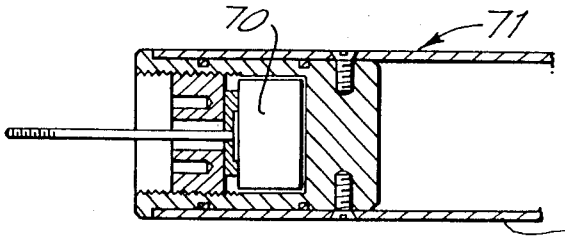
FIG. 15 is a sectional view of the receiver unit.

FIGS. 12, 13, 14 and 15 are directed to the orientation device of the invention for correctly orientating a wedging operation. Referring firstly to FIG. 12 the orientation device 60 comprises a nylon probe body 61 housing at one end four mercury switches 62 set at different predetermined angles. The mercury switches 62 serve as gravity sensitive transducers and are each connected by wiring (not shown) to a terminal board 63 which is also connected to rechargeable batteries 64 (only one shown). Adjacent the batteries 64 at the other end of the body 61, the body 61 is provided with a keyway 65 which receives the barrel 66 of a transmission sender unit 67 two alternatives of which are shown in FIGS. 13 and 14. The transmission sender unit 67 houses an ultrasonic crystal transmission transducer 68 connected to the terminal board 63 by a terminal 69 and operative to transmit ultrasonic signals of differing or different frequencies corresponding to the state of the mercury switches 62 through circuitry on the terminal board 63.

Figure 16:
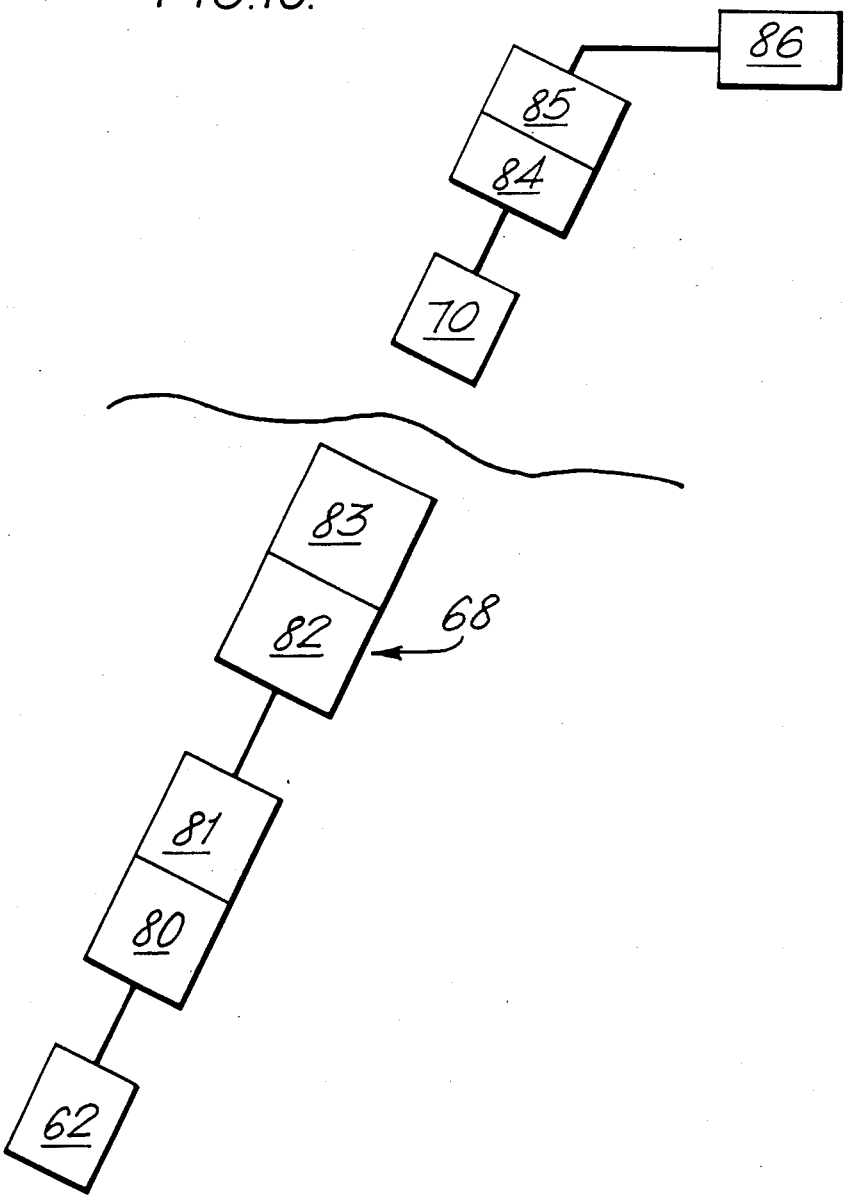
FIG. 16 is a block diagram of the circuitry of the orienting probe.

Specifically, the gravity sensitive mercury transducers 62 are operative to provide a 4-bit digital output which is encoded as a set of position modulated pulses suitable for amplitude modulating at approximately 30 KHz ultrasonic carrier frequency by means of an encoder 80 and modulator 81 on the terminal board 63 (See FIG. 16). The output from the modulator 81 is fed to the ultrasonic transmitter 68 consisting of an output amplifier 82 and a high power ultrasonic transducer 83.

The signals transmitted from the orientation probe 60 pass up to the surface via the waterfilled drill rod which acts as a wave guide and are picked up by a crystal transducer 70 in an ultrasonic receiver 71 mounted in a body 72 at the top of the highest drill rod in contact with the waterfilled rod. The output of the receiver 71 is amplified using a frequency selective amplifier 84 and detected to recover the position modulated pulses. The detector output is used as the input to a demodulator and decoder means 85. This also performs the function of error detection by comparing successive received codewords. An output is provided only if two of these are found to be the same. When an output is provided it is applied to a display 86 consisting of a set of four lamp inidcators arranged to provide a direct visual representation of the orientation of the system as sensed by the mercury transducers 62.

Thus, with a preferred number of four mercury switches 62 in the orientation probe 60, there are four lights in the display 86 arranged to be operated according to frequency or frequencies of the transmitted ultrasonic signal(s).

The orientation probe 60 is mounted in a drill rod adjacent the wedging operation to define the required wedging angle relative to the dip of the hole. The orientation cannot be satisfactorily measured at the top of the borehole since, because the drilling assembly is made up of a plurality of interconnected drill rods which are screwed together, there is always the chance of wind-up or loosened threads in the drill rods.

The mercury switches 72 are set at $22\frac{1}{2}°$ to one another and are operative to be activated within about 10° of its setting. The switches 62 are used to determine the angular position of the wedge so that the pilot or branch hole being drilled off the wedge is formed in the right direction. Before the wedging assembly is run down the borehole the orientation probe 60 in the lowermost drill rod is set relative to the orientation of the wedge relative to the dip of the hole so as to provide an optimum reading with the maximum number of lights showing. This is done by appropriately aligning a marking on the probe 60 relative to the desired orientation of the wedge whed the wedging assembly is in the borehole. Thus, as seen diagramatically in FIGS. 17*a*, 17*b* and 17*c* marking 73 on the probe 60 is aligned with respect to the angle of the wedge indicated by shading 74.

The orientation probe and receiver of the present invention provide instant information from the bottom of the borehole or at the branching station without wires or cables and avoiding the need to use acid marking during wedging. The sonic signals are transmitted up the water filled drill rod string to the receiver 71 which suitably may be connected to the standpipe or water swivel (not shown). The orientation of the wedging assembly relative to the dip of the borehole can then be determined by switching on the receiver and turning the drilling assembly until the optimum light position is achieved. The probe 60 remains in place whilst drilling off the retrieveable wedge, and is subsequently recovered with the wedging assembly. In the case of the fixed wedge the probe is recovered with the running tool.

The mercury switches 62, electronic circuitry and crystal transmitter 68 together with the batteries 64 are pressure sealed within the probe body 61. Suitably a charging transformer for the batteries 64 is provided at the surface, with the transformer and the surface display designed to run off the 12 or 24 volt drill rig systems.

We claim:

1. A wedging assembly for steering or branching a borehole comprising a wedge defining the steering or branching angle, locking means for locking the wedge in the borehole at a desired position or orientation, and means for actuating said locking means, the locking means comprising a female locking member having an annular locking surface including a plurality of angularly spaced slits extending in the direction of the borehole and defining fingers therebetween, and a male locking member cooperable with the female locking member and effective on relative movement between the female locking member and the male locking member to cause the fingers to splay outwardly to lock firmly about the wall of the borehole.

2. A wedging assembly for steering or branching a borehole comprising a wedge defining the steering or branching angle, the wedge being retrievable and defining steering deflection, locking means for locking the wedge in the borehole at a desired position or orientation, and actuating means for actuating said locking means, the locking means being annular and engaging about the wall of the borehole, the locking means comprising an annular female locking cone, and a male locking means, one of the locking means being on or adjacent the trailing end of the wedge, and the actuating means comprising a pilot hole drilling means, the female locking cone and the pilot hole drilling means being connected by first, preferential, shear means, and the male locking means and the pilot hole drilling means being connected by second shear means, the arrangement being such that shearing of the first shear means locks the wedge in position and shearing of the second shear means releases the pilot hole drilling means for drilling, the pilot hole drilling means including two interfering upsets, a first upset arranged to release the male locking means from the female locking means to release the wedge from the borehole on withdrawal of the drilling means by a first amount, the second upset being arranged to interfere with the female locking means and/or the wedge to retrieve the same on continued withdrawal of the drilling means.

3. A wedging assembly according to claim 2 wherein the male locking means is a cooperable locking cone tuned to provide a desired locking force.

4. A wedging assembly for steering or branching a borehole comprising a fixed wedge defining the steering or branching angle, locking means for locking the wedge in the borehole at a desired position or orientation, and actuating means for actuating said locking means, the locking means being annular and engaging about the wall of the borehole;

the locking means including an annular female locking cone and a male locking means positioned in advance of the wedge, and the actuating means comprising means for moving one of the locking cones or the male locking means into engagement with the other so as to cause the female locking cone to lock about the wall of the borehole.

5. A wedging assembly according to claim 4 wherein the moving means comprises a piston head on the female locking cone and means for supplying fluid under pressure behind said piston head for forcing the locking cone onto the male locking means.

6. A wedging assembling for steering or branching a borehole comprising a wedge defining the steering or branching angle, locking means for locking the wedge in the borehole at a desired position or orientation, and means for actuating said locking means, the locking means being annular and engaging about the wall of the borehole, the assembly further including a pilot hole reaming means for reaming out a pilot hole drilled off said wedge, the pilot hole reaming means comprising an outer core barrel having a reaming head, a wireline retrievable inner barrel, a pilot spear rod having a pilot spear at the leading end thereof, the pilot spear being contractable from pilot hole diameter to less than the inner diameter of the outer core barrel, first preferential shear means between the pilot spear rod and the inner barrel, and second shear means allowing contraction of the pilot spear to less than the inner diameter of the outer core barrel, the arrangement being such that the pilot spear follows the pilot hole until the first shear means is broken, the outer and inner barrels then move relative to the pilot spear to ream out the pilot hole to borehole diameter to a position adjacent the pilot spear whereupon the second shear means is broken causing contraction of the pilot spear and allowing wireline retrieval of the pilot spear assembly without removal of the outer core barrel from the borehole.

7. A wedging assembly according to claim 1 wherein the locking means is releasable to enable retrieval of the wedging assembly after use.

8. A wedging assembly according to claim 1 wherein the female locking member and the male locking member have cooperable cone-shaped ends.

* * * * *